US011266860B2

(12) United States Patent
Couture

(10) Patent No.: US 11,266,860 B2
(45) Date of Patent: Mar. 8, 2022

(54) FULL FACE MASK WITH HEAD HARNESS RECEIVING CHANNEL

(71) Applicant: 441 BLUEPRINT INC., Boucherville (CA)

(72) Inventor: Felix Couture, Boucherville (CA)

(73) Assignee: 441 BLUEPRINT INC., Boucherville (CA)

( * ) Notice: Subject to any disclaimer, the term of this patent is extended or adjusted under 35 U.S.C. 154(b) by 0 days.

(21) Appl. No.: 17/067,146

(22) Filed: Oct. 9, 2020

(65) Prior Publication Data

US 2021/0106852 A1 Apr. 15, 2021

Related U.S. Application Data

(63) Continuation of application No. 16/598,603, filed on Oct. 10, 2019, now abandoned.

(51) Int. Cl.

| | |
|---|---|
| ***A62B 18/02*** | (2006.01) |
| ***A62B 18/08*** | (2006.01) |
| ***A42B 3/04*** | (2006.01) |

(52) U.S. Cl.

CPC ..... *A62B 18/02* (2013.01); *A42B 3/0406* (2013.01); *A62B 18/084* (2013.01)

(58) Field of Classification Search

CPC ..... A42B 3/185; A42B 3/221; A62B 18/084; A62B 18/02

See application file for complete search history.

(56) References Cited

U.S. PATENT DOCUMENTS

| | | | | |
|---|---|---|---|---|
| 2,762,051 | A * | 9/1956 | Walter | A61F 9/027 2/427 |
| 4,817,596 | A | 4/1989 | Gallet | |
| 5,555,569 | A | 9/1996 | Lane | |
| 6,442,767 | B1 * | 9/2002 | Meckes | A42B 3/22 2/10 |
| 6,578,572 | B2 * | 6/2003 | Tischer | A62B 17/04 128/201.24 |
| 2002/0046752 | A1 | 4/2002 | Tischer et al. | |
| 2006/0102177 | A1 * | 5/2006 | Lewis | A62B 18/08 128/201.23 |
| 2007/0022520 | A1 | 2/2007 | Grassl et al. | |
| 2014/0190476 | A1 * | 7/2014 | Stinton | A62B 17/04 128/201.23 |
| 2017/0225016 | A1 | 8/2017 | Leggett | |

FOREIGN PATENT DOCUMENTS

| | | | |
|---|---|---|---|
| DE | 19714325 | A1 | 10/1998 |
| FR | 2668374 | A1 | 4/1992 |
| WO | 9509675 | A2 | 4/1995 |
| WO | 2005004654 | A1 | 1/2005 |

* cited by examiner

*Primary Examiner* — LaToya M Louis

(74) *Attorney, Agent, or Firm* — Norton Rose Fulbright Canada LLP

(57) ABSTRACT

There is disclosed a full-face mask to be worn in combination with a protective helmet having a suspension harness. The mask comprises a receiving channel interfacing with the suspension harness to secure the connection between them while preventing the safety helmet to physically interfere with or hinder wearing the mask. Thus, the combination of protective headgears may be worn with improved comfort and decreased risks of breaking the seal provided by the full-face mask.

20 Claims, 8 Drawing Sheets

FULL FACE MASK WITH HEAD HARNESS RECEIVING CHANNEL

CROSS-REFERENCE TO RELATED APPLICATION

This application is a Continuation-in-part of U.S. patent application Ser. No. 16/598,603 filed Oct. 10, 2019, the specification of which is hereby incorporated herein by reference in its entirety.

BACKGROUND

(a) Field

The present invention relates to protective headgear such as face masks and construction-type safety helmets, and more particularly to components and methods for wearing a combination of a full-face mask and a safety helmet.

(b) Related Prior Art

Safety is nowadays a paramount issue in chemical plants, oil field rig sites, refineries or other industrial sites. Most plants and industrial sites require their employees to wear protective headgear such as safety or hard helmet during work time, especially if they are working in a space-restricted environment where the risk of head injuries is increased. In confined or enclosed hazardous working space in presence of toxic or dangerous airborne contaminants, such as gases, fumes and/or air particles, employees are also required to wear additional piece(s) of protective equipment.

One such pieces of protective equipment are face masks, such as full-face masks integrating a lens and a respirator to protect critical and sensitive organs, notably the eyes, the nose, and the lungs. These are also known as full-face mask respirators. To offer optimal protection to a user, full-face masks must maintain a properly sealed contact with the user's face, including notably the eyes, nose, and mouth.

However, the combined wearing of a safety helmet with a full-face mask usually compromises or breaks the sealed contact between the full-face mask and at least a part of the user's face, causing health and safety risk for the user. Indeed, component(s) of the safety helmet, such as a head suspension harness used to maintain the safety helmet onto the user's head, may physically interfere or hinder with the full-face mask, including a face seal thereof.

For example, when worn in combination, either the head suspension harness of the safety helmet may push down on the full-face mask or the full-face mask may push up on the safety helmet. In all cases, a properly sealed contact between the face seal of the full-face mask and a part of the user's face may not be maintained. Further, in the event where the safety helmet receives a hit, because the suspension harness of the safety helmet may contact with and push down the full-face mask, the face mask may be displaced in relation to the user's face, also disrupting the sealed contact between the full-face mask and the user's face.

Another shortcoming of wearing a safety helmet and a full-face mask simultaneously comes from the discomfort associated with the physical interference and hindrance of the safety helmet suspension harness with the full-face mask. Even in selecting independently the size of the safety helmet and of full-face mask, it still remains difficult to find a good fit between these two pieces of personal protective gear in function of the general head morphology of the user.

This discomfort may cause the user to avoid wearing these pieces of personal protective gear when mandatory for security reasons.

Nowadays, there are known solutions of interfaces between protective gears such as the FIGHTERFIGHTING HOOD AND FULL MASK ASSEMBLY of Tischer et al., US Patent Application 2002/0046752 A1, the FIRE-FIGHTER HOOD WITH PROTECTIVE FLAP of Leggett et al., US Patent Application 2017/0225016 A1, both disclosing tabs and receiving slots to attach a protective fire-fighting hood and a full-face mask. These patent applications do not disclose a full-face mask having a receiving channel to allow resting therein of a safety helmet harness.

US Patent Application 2007/0022520 A1 of Grassl et al. entitled SAFETY HELMET WITH MODULE RING, discloses a safety helmet comprising a module ring on which can be clamped elastic clamping elements allowing to attach accessories to the helmet, comprising a breathing mask. Grassl et al. do not disclose a full-face mask having a receiving channel to allow resting therein of a safety helmet harness.

Nevertheless, none of the prior art references provide a solution to overcome the interference and hindering of the combination of a full-face mask and of the suspension harness of a safety helmet discussed hereinbefore.

Therefore, there is a need for an improved face seal for a full-face mask and/or an improved full-face mask to overcome the interference and hindering with a suspension harness of a safety helmet. The present invention addresses these needs and other needs as it will be apparent from review of the disclosure and description of the features of the invention hereinafter.

SUMMARY

According to an embodiment, there is provided a mask to be worn over a face of a user in combination with a safety helmet comprising a head suspension harness having a bottom edge and an interior surface. The mask comprises a sealing element contacting a part of a face of a user, the sealing element defining a contour comprising a forehead portion; a transparent faceguard mounted to the sealing element defining a compartment therein. One of the sealing element and the transparent faceguard comprises a forefront portion about the forehead portion. The mask comprises an upward facing receiving channel provided on the forefront portion comprising open extremities and a pair of opposed walls abutting the bottom edge and the interior surface of the suspension harness when mounted therein.

According to an aspect, the forefront portion about the forehead portion has a width, and the receiving channel extends over the width of the forefront portion.

According to an aspect, the forefront portion has an arc shape and the receiving channel has an arc shape between the extremities that follows the arc shape of the forefront portion.

According to an aspect, the extremities of the receiving channel are its lowermost points when the transparent faceguard of the mask is vertical.

According to an aspect, the receiving channel is substantially rigid.

According to an aspect, at least one of the opposed walls comprises one of a corner, a curved surface, a lip, and an abutting shape contacting a band of the suspension harness.

According to an aspect, at least one of the opposed walls comprises, is coated with or is made of anti-slip material.

According to an aspect, the sealing element defines a continuous contour with the transparent faceguard defining a continuous surface joining the sealing element, whereby the mask is a full-face mask.

According to another embodiment, there is provided a combination of protective headgears for a user having a face, a head and a forehead. The combination of protective headgears comprises a mask to be worn over the face of a user, comprising: a forehead portion contacting the forehead of the user; forefront portion about the forehead portion; and an upward-facing receiving channel located at the forefront portion comprising a pair of opposed walls. The combination of protective headgears also comprises a safety helmet to be worn over the head of the user, comprises a head suspension harness comprising a bottom edge and an interior surface, wherein the pair of opposed walls are abutting the bottom edge and the interior surface of the suspension harness when mounted therein.

According to an aspect, the forefront portion about the forehead portion has a width, and the receiving channel extends over the width of the forefront portion.

According to an aspect, the forefront portion has an arc shape and the receiving channel has extremities and an arc shape between the extremities that follows the arc shape of the forefront portion.

According to an aspect, the extremities are the lowermost portions of the receiving channel when the forefront of the mask is vertical.

According to an aspect, one of the opposed walls comprises one of a corner, a curved surface, a lip, and an abutting shape contacting a band of the suspension harness.

According to an aspect, one of the opposed walls comprises, is coated with or is made of anti-slip material.

According to an aspect, the mask comprises a sealing element having a continuous contour to contact a portion of the face of the user and a transparent faceguard mounted to and closing the sealing element thereby providing a sealed compartment of a full-face mask.

According to another embodiment, there is provided a receiving channel to be part of or mounted to a forefront portion of a mask located about a forehead portion, wherein the receiving channel is for interfacing with a suspension harness of a safety helmet worn in combination with the mask. The receiving channel comprises: an exterior surface interfacing with the mask; an upward-facing open space delimited by: a front wall; a rear wall; and open extremities, wherein the front wall and the rear wall provide abutments for bands of the suspension harness to contact against and thereby having the suspension harness being forced to bend by having a bottom edge of the suspension harness being pushed inwardly by the front wall.

According to an aspect, one of the front wall and the rear wall comprises one of a corner, a curved surface, a lip, and an abutting shape contacting a band of the suspension harness.

According to an aspect, at least part of one of the front wall and the rear wall either comprises, is coated with or is made from anti-slip material.

According to an aspect, the extremities are the lowermost points of the receiving channel when the forefront of the mask is vertical.

According to an aspect, the receiving channel has an arc shape between its extremities designed to follow an arc shape of the forefront portion of the mask.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

In the following description of the embodiments, references to the accompanying drawings are by way of illustration of an example by which the invention may be practiced. It will be appreciated that other embodiments may be made without departing from the scope of the invention disclosed herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 1:
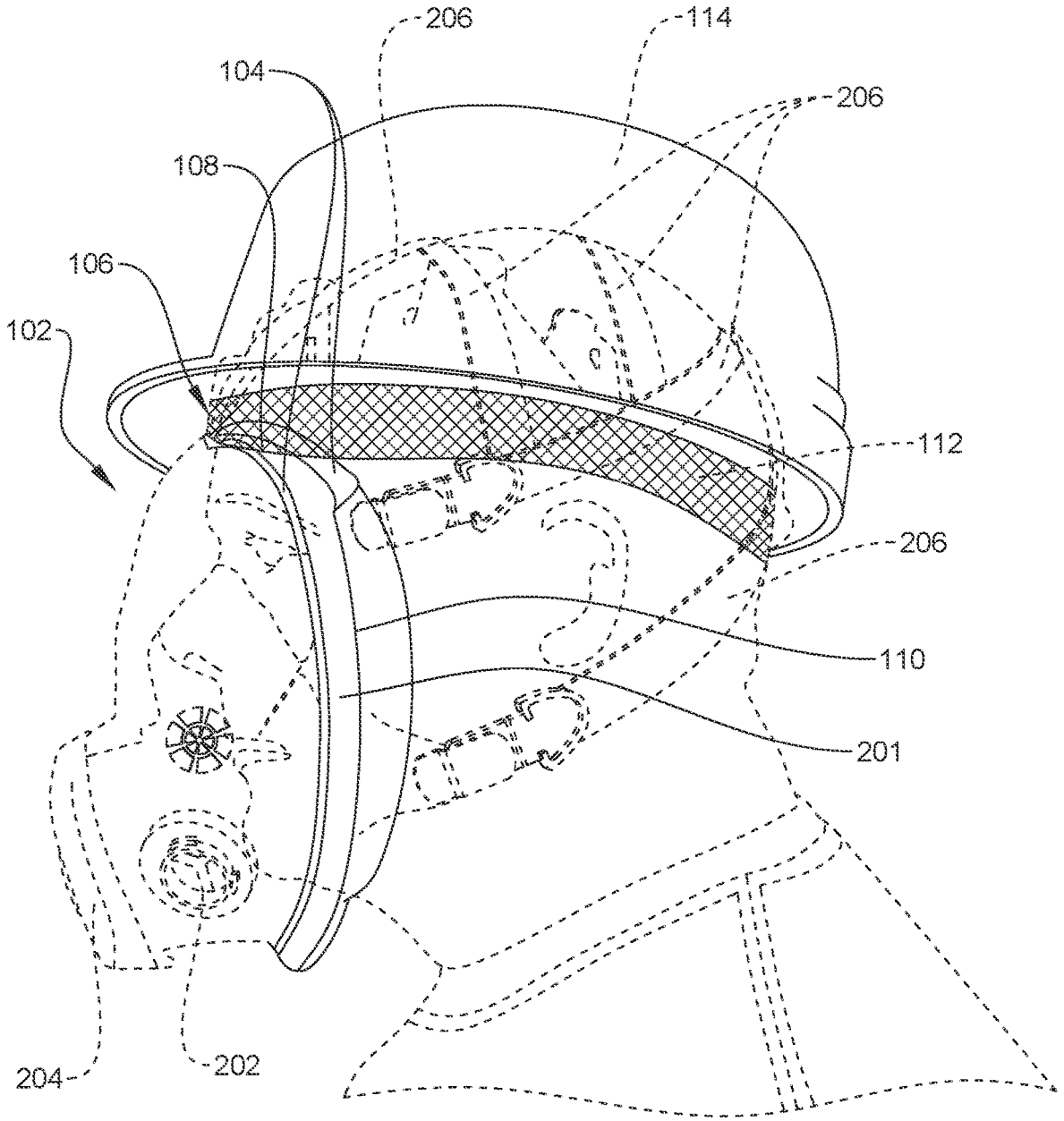
FIG. 1 is a left side elevation view a user wearing a combination of protective gears comprising a full-face mask having a receiving channel and of a safety helmet having a suspension harness interfacing with the receiving channel in accordance with an embodiment.

The terms "top", "up", "upper", "bottom", "lower", "down", "vertical", "horizontal", "interior" and "exterior" and the like are intended to be construed in their normal meaning in relation with normal installation of the product, with indication of normal orientation of the protective gears when worn by a user being provided on FIG. 1.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

With reference to FIG. 1, there is described an interface between a full-face mask 102 and a safety helmet 114 when worn by a user. The full-face mask 102 comprises a sealing element 104 and a receiving channel 106. The sealing element 104 is adapted to sealingly contact at least a part of the face of a user when the user wears the full-face mask 102. According to a particular embodiment wherein the mask is full-face mask 102 required for protection against, e.g., fumes, the sealing element 104 is adapted to sealingly contact the face of the user over un uninterrupted contour. The sealing element 104 comprises a forehead portion 108 that is adapted to contact at least a part of a forehead of the user.

Figure 7:
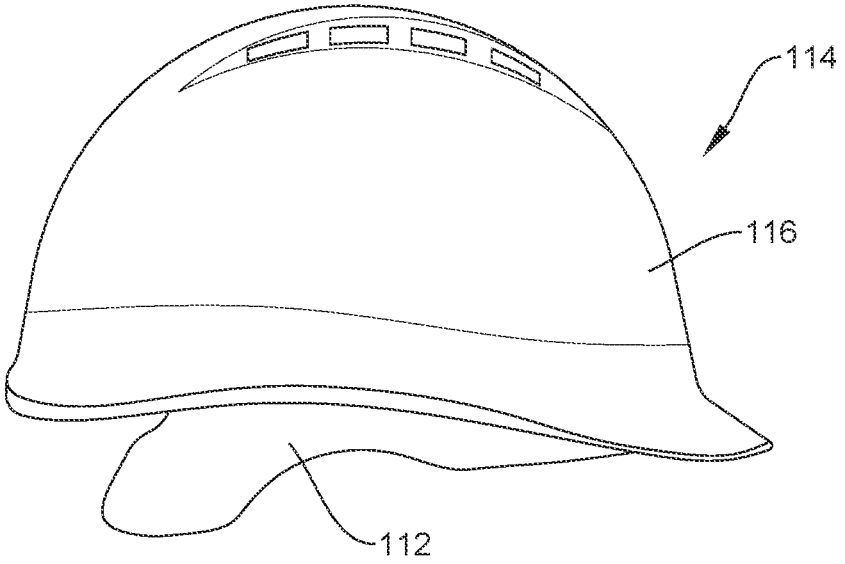
FIG. 7 is a picture showing a perspective view of a safety helmet comprising a suspension harness as can be worn by a user in combination with a full-face mask comprising a receiving channel in accordance with an embodiment.

The full-face mask 102 comprises a receiving channel 106 located on the forehead portion 108 that extends along a forefront portion 110 of the full-face mask 102. The receiving channel 106 is configured in size and shape to interface with a head suspension harness 112 of a safety helmet 114, and more precisely with a bottom portion of the head suspension harness 112 of a safety helmet 114 comprising, according to a preferred embodiment, a hard shell 116 (see FIG. 7) as is discussed hereinafter. The receiving channel 106 is adapted to provide the necessary interface between the full-face mask 102 and the head suspension harness 112 of the safety helmet 114 for the user to wear the combination thereof without interference of hinderance in-between.

Figure 6:
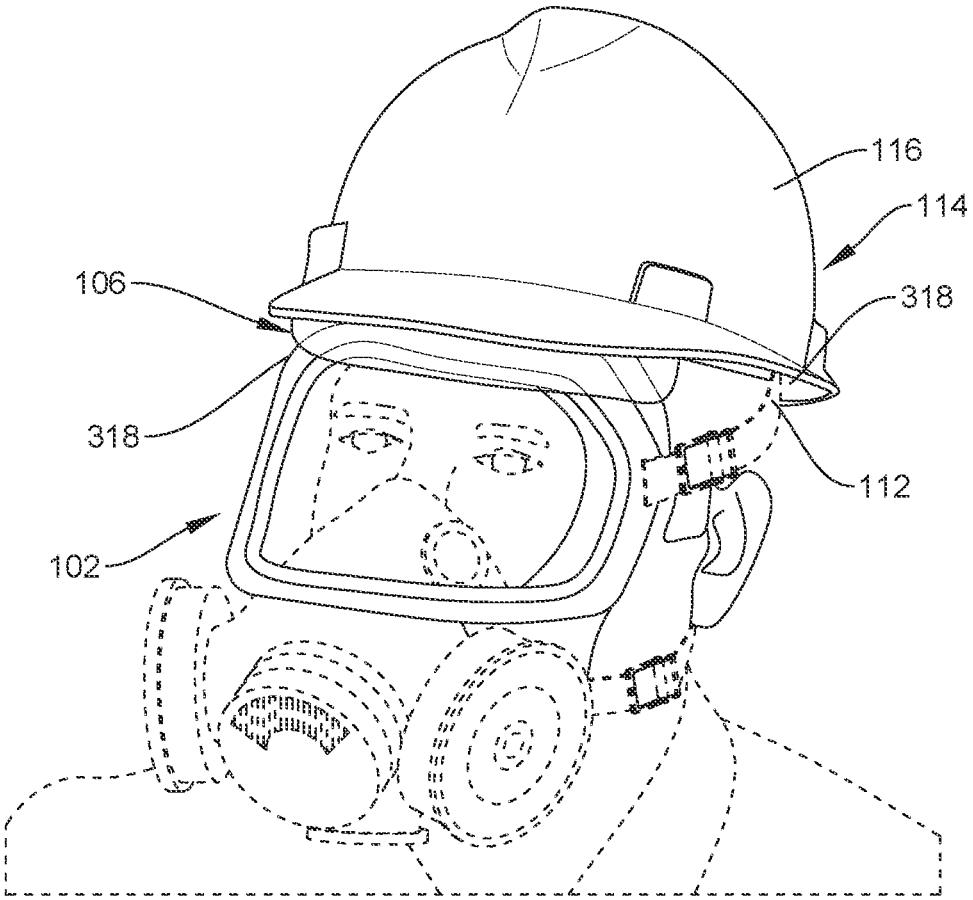
FIG. 6 is a picture showing a front perspective view of the user wearing a combination of protective gears comprising a full-face mask and a safety helmet comprising a suspension harness.

Referring additionally to FIG. 6, according to an embodiment, the receiving channel 106 is located on the forefront portion 110 of the full-face mask 102. The receiving channel 106 extends over a substantial portion of the width of the full-face mask 102 at the forehead portion 108, and according to a realization over the full width of the full-face mask 102 at the forehead portion 108.

It is to be noted that the forehead portion 108 is curved, thus as an arc shape, with the receiving channel 106 following the curve of the forehead portion 108, and thus having also an arc shape.

The receiving channel 106 has a substantially arc shape marrying a normal shape of the head suspension harness 112 of a safety helmet 114. As can be understood from the combination of the depictions of FIGS. 1 and 6, the receiving channel 106 follows an arc shape that is slightly sloped rearward, thereby resulting in the open extremities 318 of the receiving channel 106 being the lowermost points of the channel 300, with the channel 300 following the shape of the head suspension harness 112 as normally worn. In consequence, the head suspension harness 112 interfaces with the receiving channel 106 substantially at the same depth over its whole length.

As it will become apparent hereinafter, the receiving channel 106 of the interface provided by the receiving channel 106 enables the user to wear the full-face mask 102 and the safety helmet 114 simultaneously without compromising or breaking the sealed contact between the full-face mask 102 and the face of the user.

Figure 2:
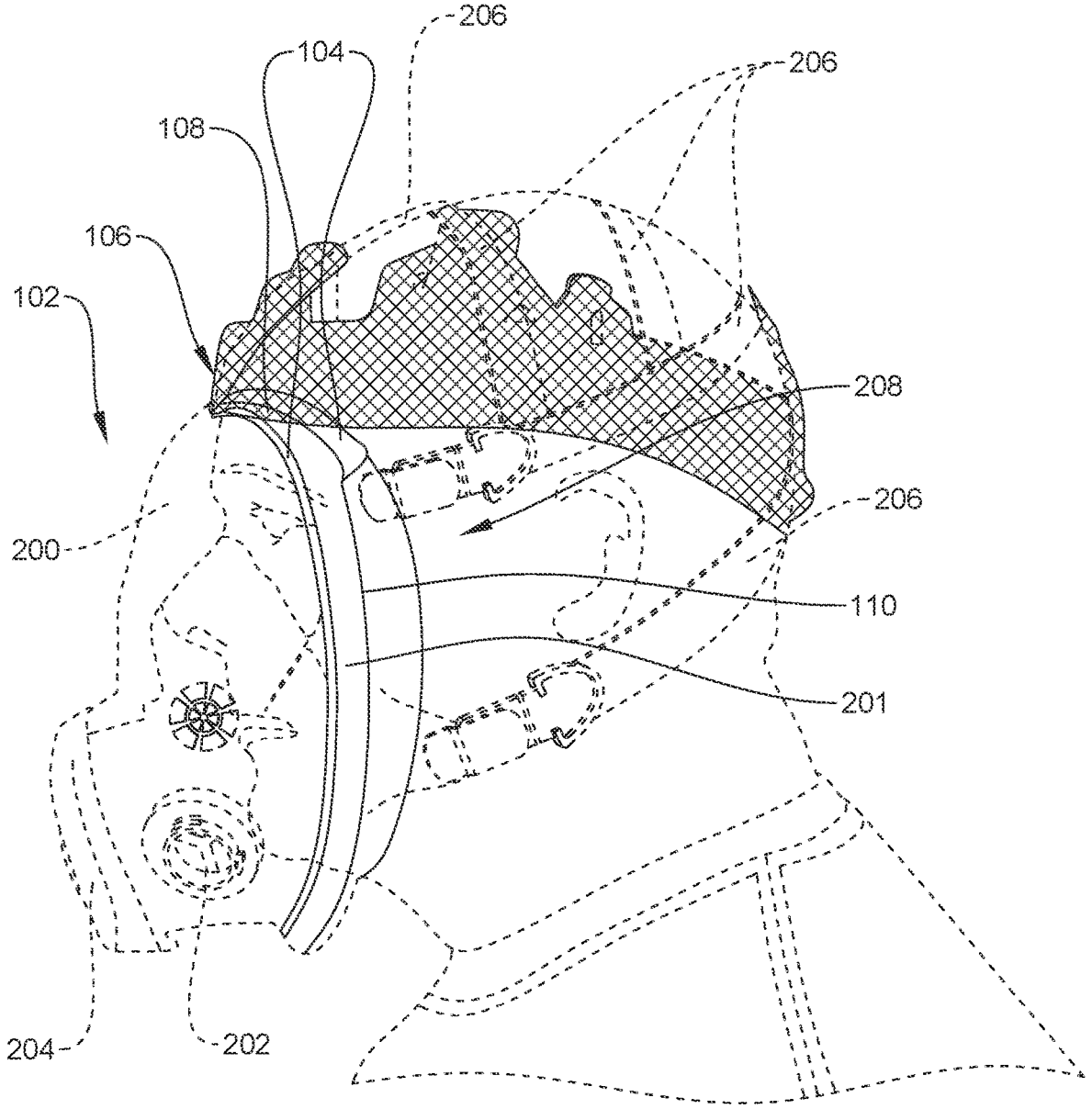
FIG. 2 is another left side elevation view of a user wearing the combination of protective gears of FIG. 1 with the hard shell of the safety helmet removed.

FIG. 2 illustrates the interface with the receiving channel 106 installed or mounted on the forehead portion 108 of the full-face mask 102 when worn by the user with a safety helmet 114 without the hard shell 116 depicted, thus with only the head suspension harness 112 depicted, for clarity. The full-face mask 102 in accordance with an embodiment comprises a frame 201, a transparent faceguard 200 operating as a window for vision, at least one air intake valves 202 attachable to at least one cartridge air filter and at least one air output valve 204 to move air in and out of the full-face mask 102 as the user breathes, and a plurality of straps 206, such as pull-straps, to strap or attach the full-face mask 102 to the head of the user. The straps 206 comprises straps that are generally located along the forefront portion 110 of the face seal 100, such as atop and on either side of the full-face mask 102, and project away therefrom. Alternatively, one or more strap(s) 206 may be provided on the frame 201 of the full-face mask 102 and extend therefrom. The full-face mask 102 has a general oval or round shape comprising a cavity 208, which is defined at least in part by the transparent faceguard 200, for providing clearance for at least a part of the face of the user therein. The cavity 208 is surrounded by the frame 201 and, when the frame 201 is installed or mounted thereon, the forefront portion 110 of the full-face mask 102. As such, the forefront portion 110 of the full-face mask 102 extends about and along the top portion of the frame 201 of the full-face mask 102. In this configuration, the sealing element 104 provides a proper sealing contact with the face of the user.

While the receiving channel 106 is depicted part of and used with the full-face mask 102, the skilled addressee will appreciate that the receiving channel 106 may be mounted to existing full-face masks 102 similar to the one depicted, or manufactured part of or mounted to any other mask, e.g. alternative configuration full-face masks or masks comprising a forehead portion, without departing from the scope of the present invention as long as the receiving channel 106 is adapted to provide an interface between the mask and a head suspension harness 112. Such alternative masks include air-purifying respirators (APRs) and supplied-air respirators (SARs), and the like. As stated, it is therethrough appreciated that the receiving channel 106 may be retrofitted to the full-face mask 102 or any other masks known in the art, including full-face mask respirators.

Figure 3A:
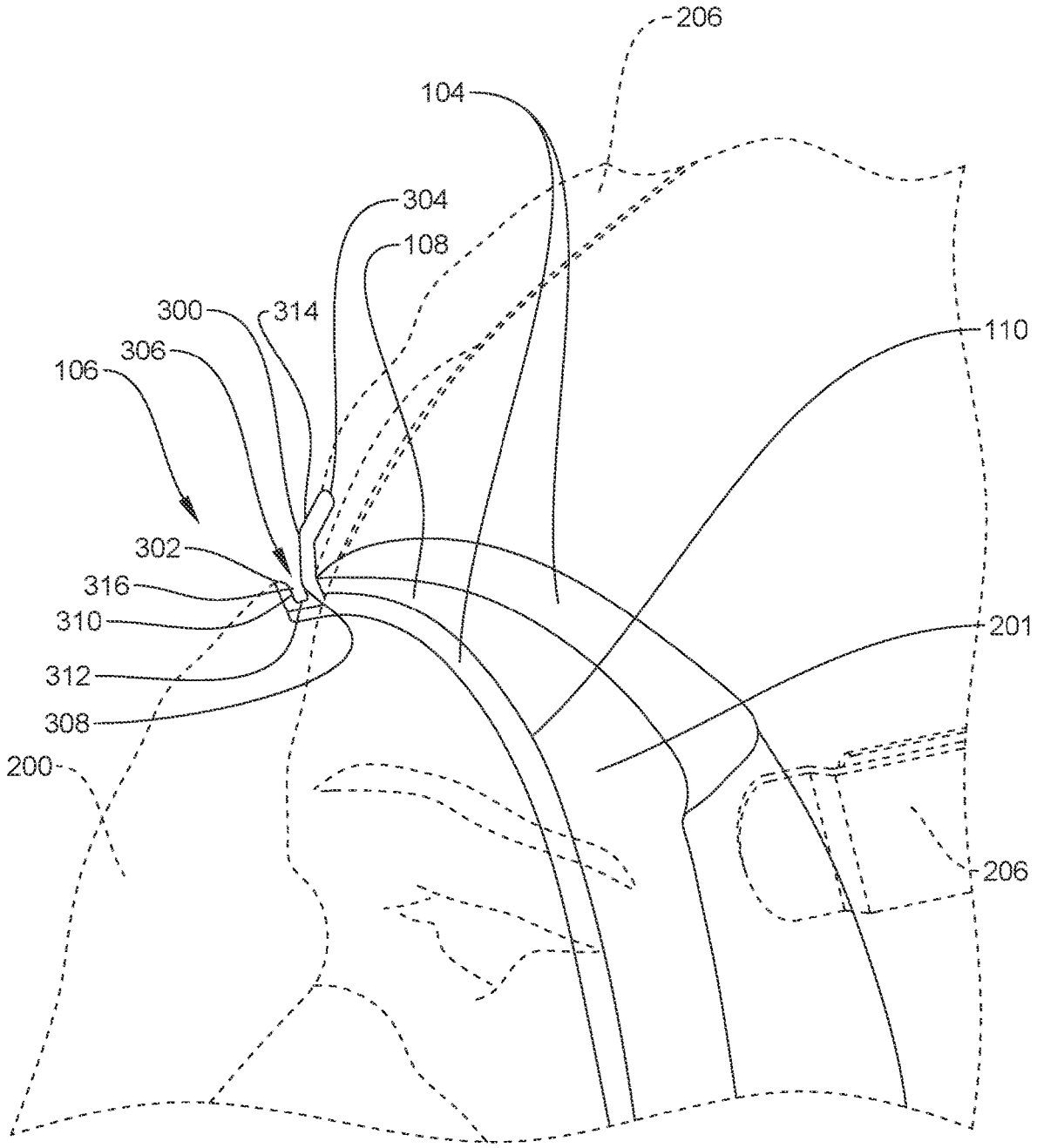
FIG. 3A is an enlarged cross-section fragmentary view of a full-face mask depicting the profile of a receiving channel adapted to interface with the suspension harness of a safety helmet in accordance with an embodiment.
Figure 3B:
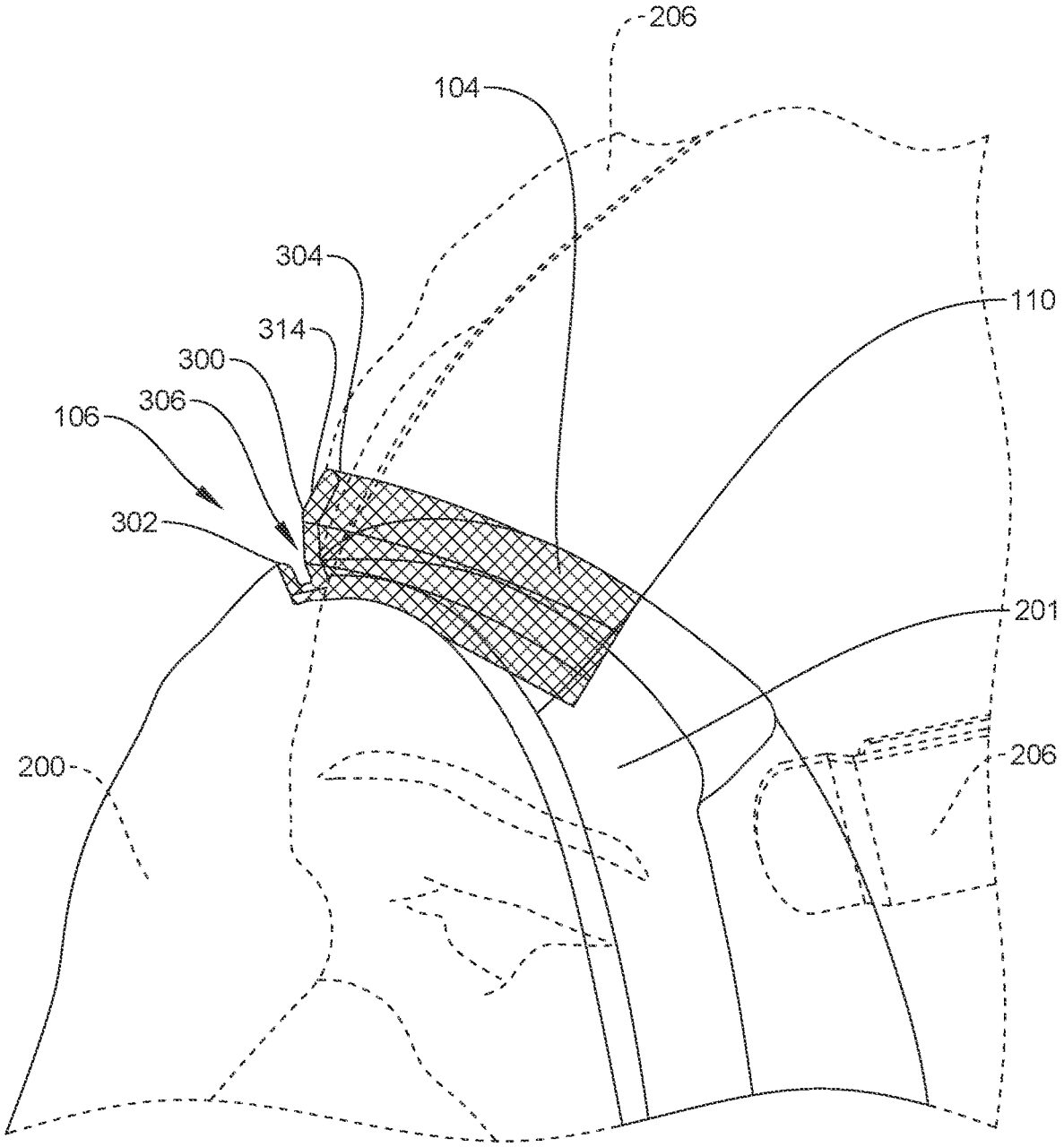
FIG. 3B is an enlarged fragmentary view of a full-face mask depicting the profile of a receiving channel adapted to interface with the suspension harness of a safety helmet in accordance with an embodiment.

Referring to FIGS. 3A-B is illustrated an embodiment of the receiving channel 106 that is located on the forehead portion 108 of the full-face mask 102 about where the latter contacts the forehead of the user. The receiving channel 106 may extend along the whole width of the forefront portion 110 corresponding to the forehead portion 108 of the full-face mask 102 or may extend over a partial portion of the full-face mask 102 along the forefront portion 110 corresponding to the forehead portion 108 of the full-face mask 102. In either configuration where the receiving channel 106 extends entirely or partially along the forefront portion 110 corresponding to the forehead portion 108, the receiving channel 106 is capable of interfacing with at least a part, aka an arc section of the head suspension harness 112 therein.

As it will become apparent hereinafter, the positioning of the receiving channel 106 on the forehead portion 108 of the full-face mask 102, and preferably on an uppermost portion of the full-face mask 102, orientates and exposes upwardly a open space 306 having open extremities for physical inter-engagement with the bottom edge 118 (FIG. 5) of the head suspension harness 112 of the safety helmet 114, wherein the open extremities of the open space 306 allows the inter-engagement of the a portion of the head suspension harness 112 with the head suspension harness 112 extending outside the open space 306 to provide a contour.

The receiving channel 106 has body 300 that is generally either curved, J-shape or have another appropriate shape providing means for interfacing as will be discussed in detailed hereinafter, as depicted in cross-section through FIG. 3A. The body 300 of the receiving channel 106 as an exterior surface 316 through which the receiving channel 106 interfaces, is set in, is attached, is mounted to, etc. to the, e.g., transparent faceguard 200 of the full-face mask 102.

The body 300 of the receiving channel 106 extends between a first end 302 and a second end 304. When the receiving channel 106 is installed on the full-face mask 102, the first end 302 is located forefront, adjacent to the transparent faceguard 200 of the full-face mask 102, and the second end 304, located rearward, projects and bends away upwardly in relation to the first end 302. In such configuration, the second end 304 of the receiving channel 106 also projects and bents upwardly to generally conform to the contour of the full-face mask 102. Adjacent to the first end 302, the body 300 of the receiving channel 106 defines a open space 306, which may also be a groove, a notch, or any other structure capable of receiving the bottom edge 118 of a portion of the head suspension harness 112 therein. As illustrated in FIGS. 3A-B and 4A-B, the receiving channel 106 comprises a pair of longitudinally opposed walls 308 and 310, aka front wall 308 and rear wall 310, as well as a floor 312 extending therebetween at the bottom of the open space 306. The pair of longitudinally opposed walls 308 and 310 as well as floor 312, wherein the open space 306 is configured in size and shape to receive at least the bottom edge 118 of an arc section of the head suspension harness 112 therein when the full-face mask 102 is worn together with the safety helmet 114 by the user.

Figure 4A:
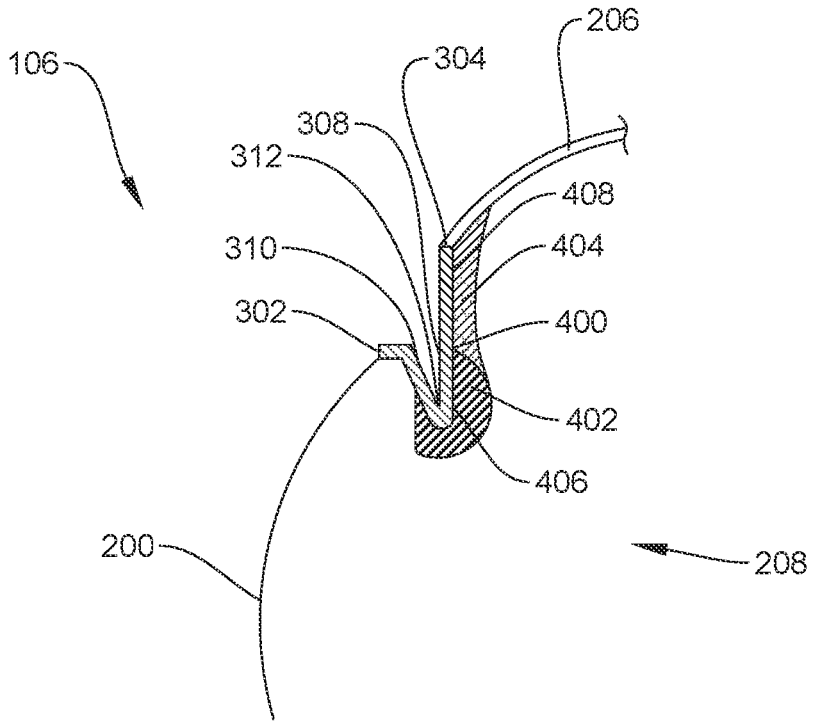
FIG. 4A is a cross-section and enlarged fragmentary view of a safety mask comprising a receiving channel connected to a strap in accordance with a particular embodiment.

Particularly, as illustrated in FIG. 4A, at least one strap 206 used to attach the full-face mask 102 to the head of the user may project from or about the second end 304 of the receiving channel 106. For example, the receiving channel 106 may form a unitary body with at least one strap 206, such as by being integrally molded with a strap 206.

Figure 4B:
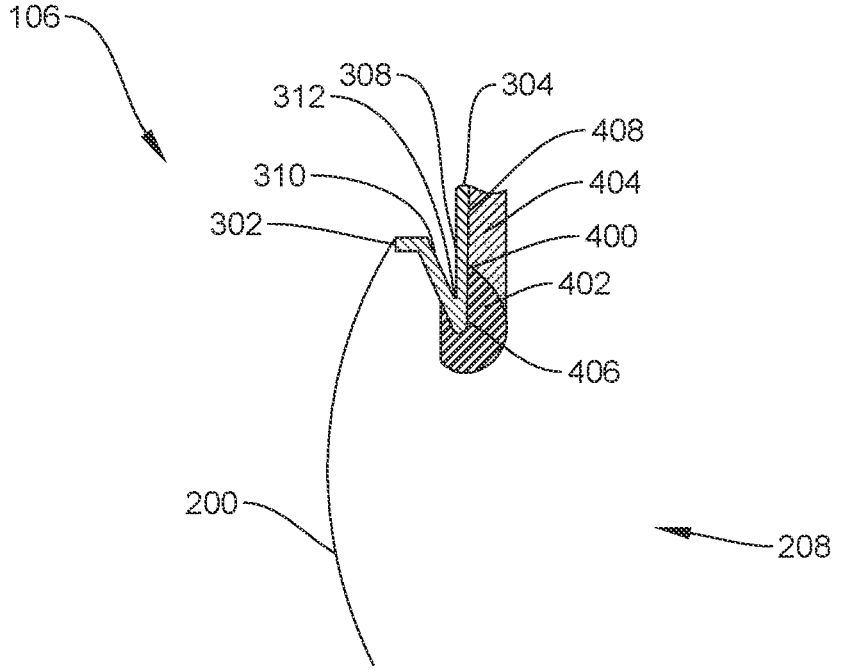
FIG. 4B is a cross-section and enlarged fragmentary view of a safety mask comprising a receiving channel free of connection to a strap in accordance with another particular embodiment.

Alternatively, as illustrated in FIG. 4B, no strap may project or may be molded with the receiving channel 106 so that the second end 304 of the receiving channel 106 projects freely away from the full-face mask 102.

In an embodiment, the receiving channel 106 may form a unitary body with the sealing element 104. For example, the receiving channel 106 may be integrally molded with the sealing element 104. In this case, the receiving channel 106 and the sealing element 104 may be made of a resiliently deformable material, including but not limited to polymer, elastomer, silicone, rubber, foam, and the like, that is adapted to form and maintain a sealed contact with at least a part of the face of the user. Alternatively, the receiving channel 106 when part of or mounted to the transparent faceguard 200 of the full-face mask 102, may be rigid or substantially rigid and may be made of polymer, plastic, composite material, fiber(s) (e.g. fiberglass), metal (e.g. aluminum), metal alloy, and the like.

In the case of a rigid or substantially rigid receiving channel 106, in an embodiment in which the receiving channel 106 participates in providing a sealed compartment for the face of the user, the receiving channel 106 may comprise a contact face 400 to contact the forehead of the user and at least one resiliently deformable element, such as the resiliently deformable element 402. The resiliently deformable element is disposed along the contact face 400 and is adapted to provide a sealed contact between the receiving channel 106 and the forehead of the user.

In another embodiment, the receiving channel 106 may form a unitary body with either the frame 201 or the transparent faceguard 200 of the full-face mask 102. Alternatively, the receiving channel 106 may be a stand-alone piece that is permanently or removably connectable to the frame 201 or transparent faceguard 200 of the full-face mask 102. In each configuration, the receiving channel 106 is located on a forefront portion 110 correspond to an uppermost portion of the full-face mask 102 that substantially correspond to the forehead portion 108. Also, the receiving channel 106 may be rigid or substantially rigid in nature and, therefore, not made of a resiliently deformable material. For example, the receiving channel 106 may be made of polymer, plastic, composite material, fiber(s) (e.g. fiberglass), metal (e.g. aluminum), metal alloy, and the like. In configuration where the receiving channel 106 is forming a unitary body with the frame 201 or the transparent faceguard 200, the receiving channel 106 may be integrally molded with the appropriate portion of the full-face mask 102. In configuration where the receiving channel 106 is a stand-alone piece, the receiving channel 106 may be removably connectable not only to the frame 201 or the transparent faceguard 200, but also with the sealing element 104. For example, the receiving channel 106 may be removably connected to any one of the frame 201 and the sealing element 104 by a snap-fit or interference fit, a quick release mechanism, a slidable engagement mechanism, and/or any other fastening or connecting mechanism know in the art.

FIGS. 4A-B illustrates embodiments of the receiving channel 106 comprising a contact face 400 to contact the forehead of the user. The contact face 400 comprises two resiliently deformable elements 402 and 404. The first resiliently deformable element 402 is disposed on a first segment 406 of the contact face 400 corresponding to the open space 306 and is continuous with the sealing element 104 of the face seal 100. The second resiliently deformable element 404 is disposed on a second segment 408 of the contact face 400 that is adjacent to the second end 304 of the receiving channel 106 and is contiguous to the second resiliently deformable element 404. Also, the second resiliently deformable element 404 is located outwardly to the first resiliently deformable element 402 in relation to the face of the user.

In this configuration, the first resiliently deformable element 402 is adapted to sealingly contact the receiving channel 106 to at least a part of a forehead of the user, while the second resiliently deformable element 404 is adapted to provide an additional contact with the forehead of the user so as to reduce the overall pressure caused by the full-face mask 102 and the safety helmet 114, respectively. This pressure reduction improves comfort for the user and therefore may increase user's resilience to wear the full-face mask 102 in combination with the safety helmet 114.

The first resiliently deformable element 402 and the second resiliently deformable element 404 are made of resiliently deformable material, such as polymer, elastomer, silicon, rubber, foam, and the like. The density and/or deformable properties of the first resiliently deformable element 402 and the second resiliently deformable element 404 may vary in order to provide optimal sealing characteristics to the sealing element 104 and pressure reducing characteristics, respectively.

Figure 5:
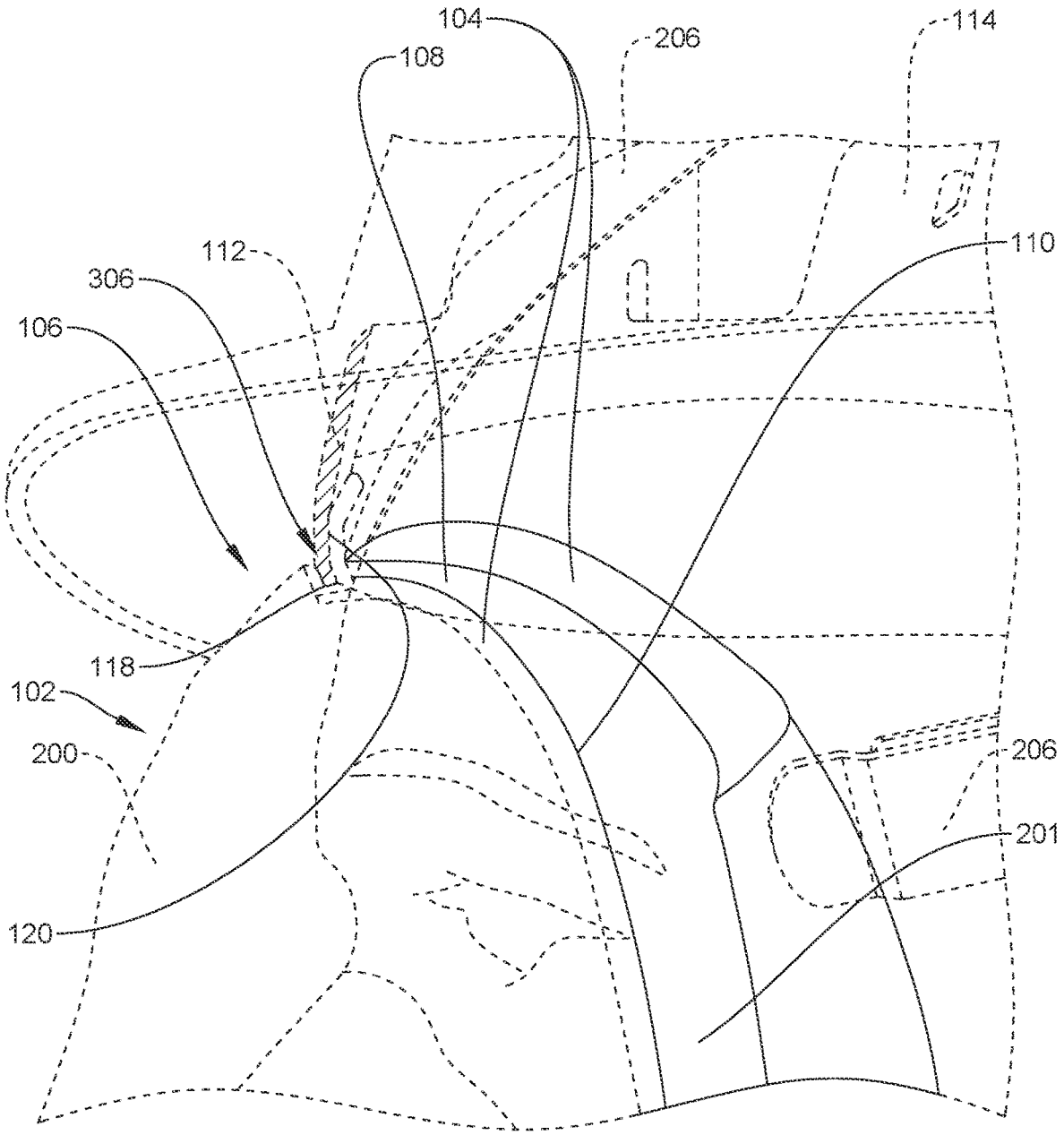
FIG. 5 is a left side elevation and enlarged fragmentary view of a user wearing a combination of protective gears with illustration of a cross-section of the suspension harness about the middle of the face of the user interfacing with the receiving channel.

Referring to FIG. 5 that illustrates the receiving channel 106 installed or mounted on the full-face mask 102 while interfacing with the head suspension harness 112 of the safety helmet 114, which are both worn by the user. As seen, the positioning of the receiving channel 106 on the forehead portion 108 of the face seal 100 directs the open space 306 of the receiving channel 106 upward with the head suspension harness 112 being received therein when the safety helmet 114 is properly worn by the user on their head. Accordingly, it will be appreciated that the receiving channel 106 provides means required for the head suspension harness 112 of the safety helmet 114 to properly engage therewith while the user wears the full-face mask 102. Hence, that configuration provides a solution min which the safety helmet 114 does not interfere or hinder with the full-face mask 102 in a way that would compromise or break the sealed contact between the full-face mask 102 and the face of the user. In other word, the receiving channel 106 enables maintaining a sealed contact between the full-face mask 102 and the face of the user while the user wears the full-face mask 102 and the safety helmet 114 at the same time.

In order to better depict the interface between the receiving channel 106 and the head suspension harness 112, one must understand the steps involves in wearing them. First, the user puts on the full-face mask 102 comprising the receiving channel 106. After, the user puts on the safety helmet 114 with the bottom edge 118 of the head suspension harness 112 resting in the open space 306. After, the user adjusts the size and position of the head suspension harness 112 with the back of the head suspension harness 112 abutting the rear of the head of the user. Adjusting the head suspension harness 112 results in the head suspension harness 112 being ties up, resulting in the bottom edge being abutted inwardly by the front wall 310. As a result, a band of the back interior surface 120 of the head suspension harness 112 pressed against a portion of the rear wall 308, resulting in the head suspension harness 112 being slightly bent in the open space 306 with the bent configuration thereof providing an aid to the weight of the safety helmet 114 for the head suspension harness 112 to remain securely interfacing with the receiving channel 106. To remove the head suspension harness 112 from the hard shell 116, the user first slightly lifts the back of the safety helmet 114 to therefore unbend the head suspension harness 112, with after the head suspension harness 112 being free to be removed from the receiving channel 106.

As such, the head suspension harness 112 abuts both of the longitudinally opposed walls 308 and 310, aka front wall 308 and rear wall 310 the body 300. According to embodiments, the receiving channel 106 may either receive the head suspension harness 112 such that there is either none or there is an empty space between the floor 312 of the open space 306 and the bottom edge 118 of the head suspension harness 112.

According to embodiments, depending on the shape of the open space 306, the open space 306 may either or not comprise a floor 312. One or more of the walls 308 and 310 of the open space 306 may comprise flat walls, curved walls, walls comprising lips, and walls comprising abutting shape (see corner 314 on the rear wall 310 on FIGS. 3A-B abutting a band of the interior surface 120 of the head suspension harness 112), wherein the additional feature(s) provides either aid(s) for bending slightly the head suspension harness 112 in the receiving channel 106, or aid(s) hindering vertical movement of the head suspension harness 112 toward an exit of the open space 306 when the head suspension harness 112 is properly in place. The angle between the longitudinally opposed walls 308 and 310 may also be adjusted according to that perspective.

According to embodiments, one or both of the longitudinally opposed walls 308 and 310 may be coated, comprises or made of an anti-slip material, or slip-decreasing material, that may provide an aid in hindering vertical movement of the head suspension harness 112 toward an exit of the open space 306 when the head suspension harness 112 is properly in place.

According to an embodiment wherein the clearance remains between the floor 312 and the bottom edge 118 of the head suspension harness 112 when the user wears the combination of protective headgears, such empty space may provide the clearance required for the head suspension harness 112 safety helmet 114 to slightly move without inducing movement to the full-face mask 102 upon a the hard shell 116 of the safety helmet 114 undergoing a shock, a blow, a hit, a strike or the like.

In an embodiment, the head suspension harness 112 is received into the receiving channel 106 and is additionally secured or fastener thereto by a snap fit (not shown) or an interference fit mechanism, or any other securing or fastening mechanism known in the art. For example, the snap fit may be located between the head suspension harness 112 and the longitudinally opposed walls 308 and 310. The securing or fastening of the full-face mask 102 with the safety helmet 114 may be advantageous in providing a more solid, robust coupling between the full-face mask 102 and the safety helmet 114.

As discussed, after being received into the receiving channel 106, the head suspension harness 112 may be snugly adjusted, such as by the use of a ratchet mechanism that reduces the diameter of the head suspension harness 112, in order for the head suspension harness 112 to mateably conform to the head of the user. In this case, the receiving channel 106 enables the safety helmet 114 to be maintained in place on the head of the user so that the safety helmet 114 may not be dislodged and fall on the ground when the user leans, for example, like it may happen with the helmets and full-face masks known in the art.

While the head suspension harness 112 is received into the receiving channel 106, the skilled addressee will appreciate that the receiving channel may be adapted to interface with any other components of other kinds of safety helmets that may interfere or hinder with the full-face mask 102, wherein such component may interface with the receiving channel 106 without departing from the scope of the present invention.

The embodiments of the invention described above are intended to be exemplary only. The scope of the invention is therefore intended to be limited solely by the scope of the appended claims.

The invention claimed is:

1. A mask to be worn over a face of a user in combination with a safety helmet, the safety helmet including a head suspension harness having a head strap sized to surround at least partially a head of the user, the mask comprising:

a sealing element configured to contact a part of the face of the user, the sealing element defining a contour comprising a forehead portion to overlap a forehead of the user, the forehead portion extending in a lateral direction between left and right sides of the head of the user during use;

a transparent faceguard mounted to the sealing element defining a compartment therein, the transparent faceguard having an upper portion configured to be located over the forehead of the user when worn by the user during use; and an upward facing receiving channel provided on one of the upper portion of the transparent faceguard and the forehead portion of the sealing element, the upward facing receiving channel having:

a pair of opposed walls defining an open space between the opposed walls, the open space sized to receive a portion of the head strap, and open extremities at opposed lateral ends of the upward facing receiving channel such that the head strap is movable laterally relative to and within the upward facing receiving channel while remaining within the upward facing receiving channel.

2. The mask of claim 1, wherein the forehead portion has a width, and wherein the receiving channel extends over the width of the forehead portion.

3. The mask of claim 1, wherein the forehead portion has an arc shape and the receiving channel has an arc shape between the open extremities that follows the arc shape of the forehead portion.

4. The mask of claim 1, wherein the open extremities are lowermost points of the receiving channel when the transparent faceguard of the mask is vertical.

5. The mask of claim 1, wherein the receiving channel is substantially rigid.

6. The mask of claim 1, wherein one of the opposed walls comprises one of a corner, a curved surface, a lip, and an abutting shape contacting the head strap.

7. The mask of claim 1, wherein one of the opposed walls comprises, is coated with, or is made of an anti-slip material.

8. The mask of claim 1, wherein the sealing element defines a continuous contour and wherein the transparent faceguard defines a continuous surface joining the sealing element, whereby the mask is a full-face mask.

9. A protective headgear for a user, comprising:

a safety helmet to be worn over a head of the user, the safety helmet having a head suspension harness including a head strap sized to surround at least partially the head of the user, a mask to be worn over a face of a user, the mask having:

a forehead portion for overlapping a forehead of the user, the forehead portion extending in a lateral direction between left and right sides of the head of the user during use, and an upward-facing receiving channel located at the forehead portion, the upward-facing receiving channel having a pair of opposed walls defining an open space between the opposed walls, the open space sized to receive a portion of the head strap, and open extremities at opposed lateral ends of the upward-facing receiving channel such that the head strap is movable laterally relative to and within the upward facing receiving channel while remaining within the upward-facing receiving channel.

10. The protective headgear of claim 9, wherein the forehead portion has a width, and wherein the receiving channel extends over the width of the forehead portion.

11. The protective headgear of claim 9, wherein the forehead portion has an arc shape and the receiving channel has an arc shape between the open extremities that follows the arc shape of the forehead portion.

12. The protective headgear of claim 11, wherein the open extremities are lowermost portions of the receiving channel when the mask is vertical.

13. The protective headgear of claim 9, wherein one of the opposed walls comprises one of a corner, a curved surface, a lip, and an abutting shape contacting the head strap of the suspension harness.

14. The protective headgear of claim 9, wherein one of the opposed walls comprises, is coated with, or is made of an anti-slip material.

15. The protective headgear of claim 9, wherein the mask comprises a sealing element having a continuous contour to contact a portion of the face of the user and a transparent faceguard mounted to and closing the sealing element thereby providing a sealed compartment; wherein the mask is a full-face mask.

16. A safety headgear assembly, comprising:

a helmet having a shell and a head suspension harness creating an interface between a head of a user and the shell, the head suspension harness having a head strap to extend over a forehead of the user; and a respiratory mask to be worn over a face of the user, the respiratory mask comprising:

a forehead portion configured to abut and at least partially overlap the forehead of the user during use, and a channel defined by the forehead portion, the channel extending in a lateral direction between left and right sides of the head of the user from a first lateral end to a second lateral end opposite the first lateral end, the channel having:

a first wall defining an abutting face abutted by the head strap such that the first wall is overlapped by the head strap, the first wall configured to be located between the head strap and the forehead of the user, a second wall extending substantially transversally from the first wall and away from the abutting face, the second wall defining a shelf face oriented upwardly and abutted by a bottom edge of the head strap, and open extremities at both of the first lateral end and the second lateral end such that the head strap is slidingly movable within the channel by a motion of the head strap relative to the first and second walls while remaining within the channel.

17. The safety headgear assembly of claim 16, wherein the respiratory mask includes a sealing element configured to contact a part of the face of the user, the sealing element defining an uninterrupted contour for sealingly engaging the face of the user, and a transparent faceguard mounted to the sealing element defining a compartment therein.

18. The safety headgear assembly of claim 17, wherein the channel is defined by one of the sealing element and the transparent faceguard.

19. The safety headgear assembly of claim 16, comprising a third wall extending transversally from a distal end of the second wall, an open space defined between the first wall and the third wall, a portion of the head strap received within the open space.

20. The safety headgear assembly of claim 16, wherein both of the first wall and the second wall are arc- shaped to follow a shape of the forehead of the user.

* * * * *